US008428506B2

(12) United States Patent
Miki

(10) Patent No.: US 8,428,506 B2
(45) Date of Patent: Apr. 23, 2013

(54) ASSIST MECHANISM AND IMAGE FORMING APPARATUS

(75) Inventor: Katsuhiko Miki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 474 days.

(21) Appl. No.: 12/458,444

(22) Filed: Jul. 13, 2009

(65) Prior Publication Data

US 2010/0007081 A1 Jan. 14, 2010

(30) Foreign Application Priority Data

Jul. 11, 2008 (JP) ..... 2008-181890

(51) Int. Cl.
*G03G 15/00* (2006.01)
*E05B 15/02* (2006.01)

(52) U.S. Cl.
USPC ..... 399/393; 292/341.13; 292/341.15

(58) Field of Classification Search ..... 399/393; 292/340, 341.13, 341.15, 341.16
See application file for complete search history.

(56) References Cited

U.S. PATENT DOCUMENTS 4,603,239 A * 7/1986 Ishii ..... 200/61.61
4,886,307 A * 12/1989 Ruckert ..... 292/216
6,050,019 A * 4/2000 Anderson ..... 43/15
6,549,741 B2 * 4/2003 Miura ..... 399/124

FOREIGN PATENT DOCUMENTS

| | | |
|---|---|---|
| JP | 09-222756 | 8/1997 |
| JP | 2006-151687 | 6/2006 |
| JP | 2007-070068 | 3/2007 |
| JP | 2008-127110 | 6/2008 |

* cited by examiner

*Primary Examiner* — Judy Nguyen
*Assistant Examiner* — Justin Olamit
(74) *Attorney, Agent, or Firm* — Harness, Dickey & Pierce, PLC

(57) ABSTRACT

An assist mechanism aids movement of a retractable unit reciprocally moving between an open and a closed position and includes a pressing device, a stopper mechanism, an engagement member, a catch portion, and a release member. The pressing device presses the retractable unit toward the open position in which the unit is extended. The stopper mechanism controls and releases retraction of the retractable unit to the closed position in which the unit is retracted, and includes a stopper and a blocking member. The engagement member is provided in the retractable unit. The catch portion engages the engagement member. The release member releases a force pulling the retractable unit when the retractable unit is moved to the closed position.

13 Claims, 9 Drawing Sheets

ASSIST MECHANISM AND IMAGE FORMING APPARATUS

PRIORITY STATEMENT

The present patent application claims priority from Japanese Patent Application No. 2008-181890, filed on Jul. 11, 2008 in the Japan Patent Office, the entire contents of which are hereby incorporated herein by reference.

BACKGROUND OF THE INVENTION

1. Field of the Invention

Example embodiments generally relate to an assist mechanism for efficiently positioning a unit of an image forming apparatus such as a paper feed device or a duplex unit, and an image forming apparatus incorporating the assist mechanism.

2. Description of the Related Art

Image forming apparatuses, such as copiers, facsimile machines, printers, and multifunction devices having at least one of copying, printing, scanning, and facsimile functions, typically form a toner image on a recording medium (e.g., a transfer sheet) based on image data using electrophotography.

For example, an image forming device of the image forming apparatus forms a toner image on a transfer sheet conveyed from a feed device of the image forming apparatus including a paper tray storing a plurality of transfer sheets. Although the paper tray can be pushed into or pulled into or out of the feed device, if the paper tray is not properly positioned in the paper feed device, the image forming device forms a faulty image on the sheet, with the image deviating from the center of the sheet in a width direction of the sheet.

To prevent such improper positioning, some related-art image forming apparatuses include a positioning device including a pressing device and a stopper mechanism. The stopper mechanism controls movement of a paper tray, and includes a stopper and a blocking member. When the pressing device presses the paper tray to make the stopper contact the blocking member, the paper tray is properly positioned in a feed device, so that an image can be formed on the center of a sheet in a width direction of the sheet. In addition, the stopper mechanism controls movement of the paper tray, thereby preventing the paper tray from sudden removal from the feed device.

When the paper tray is empty, or when a user wants to change a sheet size or the like, the user pulls the paper tray out of the feed device by pulling a lever to release control of the stopper mechanism. After supplying a new sheet to the paper tray, the user pushes the paper tray into the feed device. However, when the paper tray is too heavy, in order to attach the paper tray to the feed device, the user has to press the paper tray with much force, causing deviation of a sheet from a proper installation position or damage to the paper tray.

Other related-art image forming apparatuses include an assist mechanism for automatically pulling a paper tray into a predetermined position of a feed device. Such automatic assist mechanism can reduce the burden on the user, as well as reduce the impact of the paper tray on the feed device during insertion of the tray, thereby preventing deviation of a sheet from a proper position or damage to the paper tray.

However, because the assist mechanism continues to pull the paper tray after attachment of the paper tray, when the pulling force is greater than the force with which the pressing device pressers the paper tray, the stopper does not contact the blocking member and the paper tray cannot be positioned properly at a predetermined position. However, when the pulling force is smaller than the pressing force of the pressing device, the paper tray supplied with sheets cannot be automatically pulled into the feed device. As a result, the user has to push the paper tray into the feed device unassisted.

Accordingly, there is a need for a technology capable of properly positioning the feed tray unit at a predetermined position in the feed device of the image forming apparatus.

SUMMARY

At least one embodiment provides an assist mechanism that includes a pressing device, a stopper mechanism, an engagement member, a catch portion, and a release member. The pressing device is configured to press the retractable unit toward the open position in which the unit is extended. The stopper mechanism is configured to control and release retraction of the retractable unit to the closed position in which the unit is retracted. The stopper mechanism includes a stopper and a blocking member. The blocking member is configured to contact the stopper. The engagement member is provided in the retractable unit. The catch portion is configured to engage the engagement member. The release member is provided in the base of the assist mechanism and configured to release a force pulling the retractable unit when the retractable unit is moved to the closed position.

Further, at least one embodiment provides an assist mechanism that includes a pressing device, a stopper mechanism, an engagement member, a catch portion, and a release member. The pressing device is configured to press the openably closable unit toward the open position in which the unit is extended. The stopper mechanism is configured to control and release opening of the openably closable unit. The stopper mechanism includes a stopper and a blocking member. The blocking member is configured to contact the stopper. The engagement member is provided in the openably closable unit. The catch portion is configured to engage the engagement member. The release member is provided in the base of the assist mechanism and configured to release a force pulling the openably closable unit when the openably closable unit is moved to the closed position.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
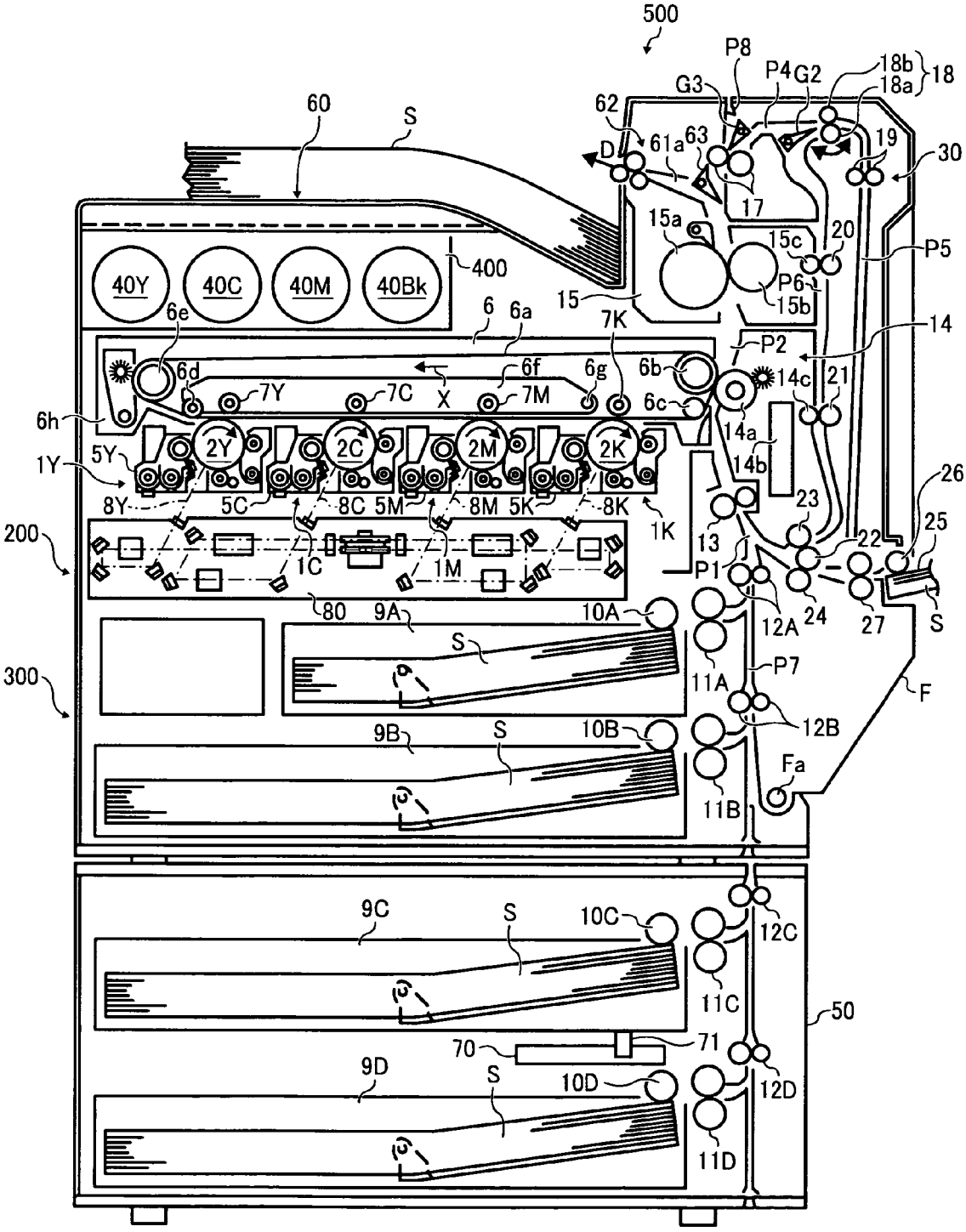
FIG. 1 is a schematic sectional view of a printer according to an example embodiment.

The accompanying drawings are intended to depict example embodiments and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms a "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Figure 2:
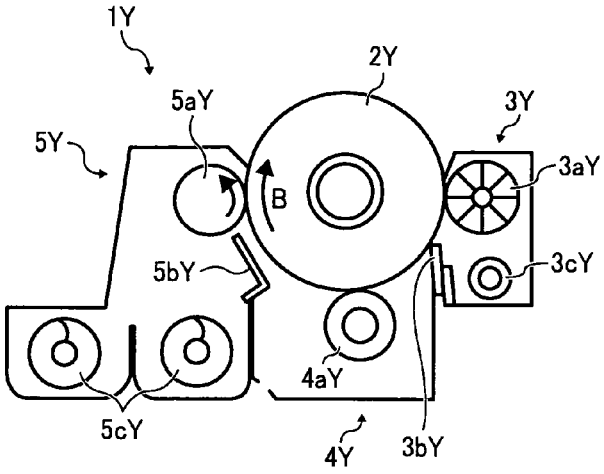
FIG. 2 is a schematic sectional view of an image forming device included in the printer shown in FIG. 1.

Referring now to the drawings, wherein like reference numerals designate identical or corresponding parts throughout the several views thereof, in particular to FIGS. 1 and 2, the structure of a printer 500, serving as an image forming apparatus, according to an example embodiment of the present invention is described.

FIG. 1 is a schematic perspective view of the printer 500, which in this embodiment is a tandem-type color laser printer. The printer 500 includes an image forming device 200, a first feed device 300, and a second feed device 50. The image forming device 200 includes image forming units 1Y, 1M, 1C, and 1K, an exposure device 80, an intermediate transfer unit 6, an attachment device 400, a secondary transfer unit 14, a bypass tray 25, a side frame F, a feed roller 26, a reverse roller 27, rollers 22, 23, and 24, a fixing device 15, a switching nail 63, a guide member 61*a*, a discharge roller 62, a duplex unit 30. The attachment device 400 includes toner cartridges 4Y, 4M, 4C, and 4K. The secondary transfer unit 14 includes a secondary transfer roller 14*a*, a power source 14*b*, a roller 14*c*, and a conveyance path P2.

The image forming units 1Y, 1M, 1C, and 1K includes photoconductors 2Y, 2M, 2C, and 2K and development devices 5Y, 5M, 5C, and 5K, respectively. The intermediate transfer unit 6 includes an intermediate transfer belt 6*a*, a plurality of rollers 6*b*, 6*c*, 6*d*, and 6*e*, primary transfer rollers 7Y, 7M, 7C, and 7K, a tension roller 6*e*, a belt cleaner 6*h*, an inner frame 6*f*, and a frame shaft 6*g*. The first feed device 300 includes paper trays 9A and 9B, feed rollers 10A and 10B, separation rollers 11A and 11B, pairs of conveyance rollers 12A and 12B, a feed path P1, and a pair of registration rollers 13. The fixing device 15 includes a fixing roller 15*a*, a pressure roller 15*b*, and a roller 15*c*. The duplex unit 30 includes a switch back path P5, a re-feeding path P6, a second switching nail G2, a third switching nail G3, a pair of inverting rollers 18 including rollers 18*a* and 18*b*, a pair of rollers 17, an inverting conveyance path P4, a discharge path P8, and a pair of rollers 19. The second feed device 50 includes paper trays 9C and 9D, feed rollers 10C and 10D, separation rollers 11C and 11D, pairs of conveyance rollers 12C and 12D, an assist mechanism 70 including an engagement projection 71. The side frame F includes a rotation shaft Fa.

The image forming units 1Y, 1M, 1C, and 1K, serving as image forming devices, are provided inside a body of the printer 500, and form yellow, magenta, cyan, and black toner image, respectively. The drum-like photoconductors 2Y, 2M, 2C, and 2K are provided inside the image forming units 1Y, 1M, 1C, and 1K, disposed in parallel and equally separated from each other, and are driven by a driving source to rotate in a direction x when the printer 500 works.

A development device and the like, describe later, necessary for electrophotographic image formation are provided around the photoconductors 2Y, 2M, 2C, and 2K to form the image forming units 1Y, 1M, 1C, and 1K, respectively.

It is to be noted that the image forming units 1Y, 1M, 1C, and 1K have a same structure except that they form different toner colors.

FIG. 2 is a schematic sectional view of the image forming unit 1Y. The image forming unit 1Y further includes a charging device 4Y and a cleaner 3Y provided around the photoconductor 2Y in order of an electrophotographic image formation process. The charging device 4Y includes a charging roller 4*a*Y opposing the photoconductor 2Y. The development device 5Y includes a development roller 5*a*Y, a development blade 5*b*Y, and a screw 5*c*Y. The cleaner 3Y includes a cleaning brush 3*a*Y, a cleaning blade 3*b*Y, and a collection screw 3*c*Y.

The photoconductor 2Y includes a layer structure made of an organic semiconductor layer being a photoconductive material provided on an aluminum cylindrical surface having a diameter of from about 30 to about 120 mm, for example. Alternatively, the photoconductor 2Y may have a belt-like shape.

As illustrated in FIG. 1, the exposure device 80 is provided below the photoconductors 2Y, 2M, 2C, and 2K, and emit laser beams 8Y, 8M, 8C, and 8K for respective color image data to respective surfaces of the photoconductors 2Y, 2M, 2C, and 2K uniformly charged by the charging devices 4Y, 4M, 4C, and 4K to form electrostatic latent images on the surfaces of the photoconductors 2Y, 2M, 2C, and 2K. As illustrated in FIG. 2, a long narrow space is provided between the charging device 4Y and the development device 5Y in a direction of an axis of rotation of the photoconductor 2Y so as to direct the laser beam 8Y from the exposure device 8Y to the photoconductor 2Y.

The exposure device 80 depicted in FIG. 1 uses a laser scanning method using a laser beam source, a polygon mirror, and the like and emits the laser beams 8Y, 8M, 8C, and 8K modulated based on image data from four laser diodes, respectively. The exposure device 80 includes a metal or resin housing for storing an optical member and a control member, and includes a translucent dust-proof member provided on a light-emitting exit on the upper surface of the exposure device 80. According to this example embodiment, the exposure device 80 has a single housing. Alternatively, a plurality of exposure device 80 may be separately provided in the image forming units 1Y, 1M, 1C, and 1K, respectively. As well as the exposure device 80 using the laser beams 8Y, 8M, 8C, and 8K, an exposure device combining a known LED (light-emitting diode) array and an imaging member may be used.

When a toner detector detects that the development devices 5Y, 5M, 5C, and 5K consume the yellow, magenta, cyan, and black toner, a toner supplier provided in the body of the printer 500 supplies fresh toner from the toner cartridges 40Y, 40M, 40C, and 40K provided in an upper portion of the printer 500 and storing respective toner to the development devices 5Y, 5M, 5C, and 5K. The toner cartridges 40Y, 40M, 40C, and 40K are cases made of a resin, paper or the like, including an outlet, and easily detachably attachable to the attachment device 400. When the toner cartridges 40Y, 40M, 40C, and 40K are attached to the attachment device 400, each outlet of the toner cartridges 40Y, 40M, 40C, and 40K connects to each toner supplier. In order not to supply different color toner by mistake due to erroneous attachment, an erroneous attachment prevention device for making the attachment device 400 correspond to each shape of the toner bottles 40Y, 40M, 40C, and 40K.

Two screws 5*c*Y are provided in the development device 5Y and used for agitation and conveyance of toner and carrier. When the development device 5Y is provided in the printer 500, one end of the toner supplier is connected to an upper portion of the screw 5*c*Y provided on the left side of FIG. 2. When the screw 5*c*Y supplies yellow toner to the development roller 5*a*Y rotating in a direction B, the development blade 5B controls a thickness of a toner layer supplied to a surface of the development roller 5*a*Y so as to keep a predetermined thickness of the toner layer. The development roller 5*a*Y is a cylinder made of stainless steel or aluminum, rotatably supported by a frame of the development device 5Y so as to keep a proper distance from the photoconductor 2Y, and includes a magnet to form a predetermined magnetic line inside the development roller 5*a*Y.

When the exposure device 80 depicted in FIG. 1 emits the laser beams 8Y, 8M, 8C, and 8K to the respective surfaces of the photoconductors 2Y, 2M, 2C, and 2K, respective color electrostatic latent images are formed on the respective surfaces of the photoconductors 2Y, 2M, 2C, and 2K. Thereafter, the development devices 5Y, 5M, 5C, and 5K develop the respective color electrostatic latent images into visible toner images.

As illustrated in FIG. 1, the intermediate transfer unit 6 is provided above the photoconductors 2Y, 2M, 2C, and 2K. The intermediate transfer belt 6*a* serving as an image carrier is wrapped around and supported by the plurality of rollers 6*b*, 6*c*, 6*d*, and 6*e* and moves in the direction x as the roller 6*b* rotates due to the force of a driving source. The endless intermediate transfer belt 6*a* contacts the respective surfaces of the photoconductors 2Y, 2M, 2C, and 2K after the respective surfaces of the photoconductors 2Y, 2M, 2C, and 2K pass through the development devices 5Y, 5M, 5C, and 5K. The primary transfer rollers 7Y, 7M, 7C, and 7K are provided on an inner circumferential surface of the intermediate transfer belt 6*a* and oppose the photoconductors 2Y, 2M, 2C, and 2K, respectively.

The belt cleaner 6*h* is provided on the outer circumferential surface of the intermediate transfer belt 6*a* and opposes the roller 6*e*, and remove residual toner remaining on the surface of the intermediate transfer belt 6*a* and foreign substances such as paper powder and the like. The roller 6*e* opposing the belt cleaner 6*h* provides tension with the intermediate transfer belt 6*a*.

For example, the intermediate transfer belt 6*a* includes a base made of a resin film or rubber having a thickness of from about 50 to about 600 μm, and has a resistance value capable of electrostatically transferring the toner image carried by each of the photoconductors 2Y, 2M, 2C, and 2K to the surface of the intermediate transfer belt 6*a* due to a bias applied to each of the primary transfer rollers 7Y, 7M, 7C, and 7K. The above members relating to the intermediate transfer belt 6*a* are combined with the intermediate transfer belt 6*a* to form the intermediate transfer unit 6 and detachably attachable to the printer 500.

The intermediate transfer belt 6*a* is made by dispersing carbon on polyamide, and has a volume resistance value of from about $10^6$ to about $10^{12}$ Ωcm. In order to keep the intermediate transfer belt 6*a* to move stably, a rib for preventing deviation of the intermediate transfer belt 6*a* is provided on one side of the intermediate transfer belt 6*a* or both sides of the intermediate transfer belt 6*a*.

For example, the primary transfer roller 7 includes a metal roller as a core metal, a surface of which is covered with a conductive rubber material. A power source supplies a bias to the core metal of the primary transfer roller 7. The conductive rubber material is made up of carbon-dispersed urethane rubber, and has a volume resistance value of about $10^5$ Ωcm. Alternatively, the primary transfer roller 7 may be made of a metal roller not including a rubber layer.

The secondary transfer roller 14A is provided on the outer circumferential surface of the intermediate transfer belt 6*a* and opposes the roller 6*b* as a support roller across the intermediate transfer belt 6*a*, and includes a metal roller as a core metal, a surface of which is covered with carbon-dispersed conductive rubber having a volume resistance value of about $10^7$ Ωcm. The power source 14*b* supplies a bias to the core metal of the secondary transfer roller 14A. The secondary transfer roller 14*a* contacts the intermediate transfer belt 6*a* to oppose the roller 6*b* to form a secondary transfer nip as a secondary transfer portion. When a transfer sheet S as a recording medium passes through the secondary transfer nip formed between the intermediate transfer belt 6*a* and the secondary transfer roller 14*a*, a toner image carried by the intermediate transfer belt 6*a* is electrostatically transferred to the transfer sheet S due to a bias applied to the transfer sheet S.

A plurality of paper trays, for example, two paper trays 9A and 9B are provided in the feed device 300 provided below the exposure device 80 and can be pulled out from the feed device 300. The paper trays 9A and 9B selectively feed a transfer sheet S as the feed rollers 10A and 10B rotate. Then, the separation rollers 11A and 11B, and the pairs of conveyance rollers 12A and 12B feed the transfer sheet S to the feed path P1, serving as a sheet conveyance path.

The pair of registration roller 13 is provided in the feed path P1, and temporally stops the transfer sheet S and then properly feeds the transfer sheet S to the secondary transfer portion, that is, the secondary transfer nip formed between the intermediate transfer belt 6*a* and the secondary transfer roller 14*a*.

The bypass tray 25 as a manual feed tray is provided in the printer 500, and can rotate to be stored in the side frame F forming one part of the body of the printer 500 when not in use. When the feed roller 26 feeds the uppermost transfer sheet S stored in the bypass tray 25, the reverse roller 27 as a separation member separates the sheet S from other sheets S, and then the rollers 22 and 24 conveys the sheet S to the pair of registration roller 13 via the feed path P1.

The fixing roller 15 is provided above the secondary transfer nip, and includes a heating member. The fixing roller 15*a* incorporates a heater, and the pressure roller 15*b* contacts and presses against the fixing roller 15*a*. It is to be noted that the structure of the fixing device 15 is not limited to that described above. Alternatively, the fixing device 15 may use a belt, an induction heating (IH) method, or the like.

The switching nail 63 is rotatable, and when the switching nail 63 is in a state as indicated in FIG. 1, the guide member 61*a*, that forms a discharge path, guides the transfer sheet S after fixing. Then, the transfer sheet S is discharge to the output tray 60 provided on the printer 500 as indicated by arrow D as the discharge-roller 62 rotates and stacked on the paper tray 60.

The duplex unit 30, serving as an openably closable unit, automatically forms an image on both sides of a transfer sheet S.

The switch back path P5 and the re-feeding path P6 are provided inside the side frame F. The switching nail 63, the second and third switching nails G2 and G3 are provided to convey the transfer sheet S after image formation on one side of the sheet to the feed path P1. The inverting roller 18*a* connected to a driving source can rotate in a reverse direction under the control of the driving source. When the roller 22 contacting the rollers 23 and 24 rotates in a clockwise direction, the roller 22 conveys the transfer sheet S from the bypass tray 25 together with the roller 24, and when the roller rotates in a counterclockwise direction, the roller 22 refeeds a transfer sheet S passing through the re-feeding path P6 in a direction of the pair of registration roller 13 together with the roller 23.

When the switching nail 63 rotates clockwise, the pair of rollers 17 guides the transfer sheet S after fixing to the inverting conveyance path P4 and to the pair of inverting rollers 18 via the second switching nail G2, and to the switch back path P5. After the transfer sheet S is conveyed to the switch back path P5, the roller 18*a* of the pair of the inverting rollers 18 rotates counterclockwise, and when the second switching nail G2 rotates counterclockwise, the transfer sheet S is fed from the switch pack path P5 to the re-feeding path P6. After the rollers 15*c* and 20 and the rollers 14*c* and 21 convey the transfer sheet S through the re-feeding path P6, the rollers 22 and 23 convey the transfer sheet S to the pair of registration roller 13.

As illustrated in FIG. 1, the second feed device 50 is provided below the feed device 300. Two paper trays 9C and 9D are provided in the feed device 50. Alternatively, the increased number of the paper trays may be provided, or each paper tray may store an increased number of transfer sheets S.

The third switching nail G3 is provided in an upper portion of the fixing device 15 and disposed downstream from the pair of rollers 17 in a direction of conveyance of the transfer sheet S. When the third switching nail G3 rotates counterclockwise, the transfer sheet S after fixation is guided to the discharge path P8 to be discharged to a sheet discharge device provided separately from the printer 500. Such discharge device is, for example, a bin tray including several discharge trays.

Single-sided printing for forming an image on one side of a transfer sheet S is described.

When the laser beam 8Y corresponding to yellow image data emitted by a laser diode of the exposure device 80 depicted in FIG. 1 is directed to the surface of the photoconductor 2Y uniformly charged by the charging roller 4*a*Y, an electrostatic latent image is formed on the surface of the photoconductor 2Y. The electrostatic latent image is subjected to a development process performed by the development roller 5*a*Y and developed with yellow toner to be made visible as a yellow toner image. Then, the primary transfer roller 7Y primarily transfers the toner image onto the surface of the intermediate transfer belt 6*a* moving in association with the photoconductor 2Y. As with the photoconductor 2Y, the photoconductors 2C, 2M, and 2K sequentially form cyan, magenta, and black toner images.

Therefore, the cyan, magenta, and black toner images are transferred and superimposed on one another on the surface of the intermediate transfer belt 6*a* to form a full color toner image. The full color toner image is carried by the intermediate transfer belt 6*a* moving in the direction x. When the surface of the photoconductor 2Y passes a position opposing the primary transfer roller 7Y across the intermediate transfer belt 6*a*, the cleaner 3Y depicted in FIG. 2 removes residual toner and foreign substances remaining on the surface of the photoconductor 2Y.

The secondary transfer roller 14*a* secondarily transfers the full color toner image formed on the intermediate transfer belt 6*a* onto a transfer sheet S conveyed in association with the intermediate transfer belt 6*a*. The belt cleaner 6*h* cleans the surface of the intermediate transfer belt 6*a* and prepare for a subsequent image formation and transfer process.

When the fixing device 15 fixes the toner image formed on the transfer sheet S, the discharge roller 62 discharges the transfer sheet S to the discharge tray 60 with an image-bearing side of the sheet facing down.

Duplex printing for forming images on both sides of a transfer sheet S is described.

As with the case of single-sided printing, after a toner image is transferred to one side of a transfer sheet S from the intermediate transfer belt 6*a*, the transfer sheet S after passing the fixing device 15 is guided to the pair of rollers 17 by the switching guide 63. Then, after passing through the third switching guide G3 and the inverting conveyance path P4 provided downstream from the pair of rollers 17 in the direction of conveyance of the transfer sheet S, the transfer sheet S moves to the upper side of the second switching guide G2 provided in a position of rotation of the duplex unit 30 and is conveyed to the switch back path P5 via the pair of inverting rollers 18. During this process, the roller 18*a* of the pair of inverting rollers 18 rotates clockwise. The pair of rollers 19 provided in the switch back path P5 also can rotate in both forward and reverse directions. To be specific, once the switch back path P5 receives the transfer sheet S, the pair of rollers 19 reverses the transfer sheet S and feeds the sheet S in a reverse direction. When the pair of rollers 19 and the pair of inverting rollers 18 rotates in the opposite direction, the second switching guide G2 rotates counterclockwise. With a rear end of the transfer sheet S entering the switch back path P5 becoming a, the rollers 15*c* and 20 and the rollers 14*c* and 21 convey the transfer sheet S through the re-feeding path P6 via the feeding path P1 to the pair of registration roller 13. Then, the pair of registration roller 13 properly conveys the transfer sheet S bearing an image on one side toward the secondary transfer nip formed between the secondary transfer roller 14*a* and the intermediate transfer belt 6*a*, thereby transferring a toner image formed on the intermediate transfer belt 14*a* on another side of the transfer sheet S.

An image to be formed on another side on the sheet S is sequentially formed in an imaging process starting when the transfer sheet S is conveyed to a predetermined position. The imaging process is similar to the full color toner image formation for single-sided printing as described above. Thus, the intermediate transfer belt 14*a* carries the full color toner image. Since the transfer sheet S is reversed in a conveyance path, that is, the re-feeding path P6, creation of image data emitted from the exposure device 80 is controlled so as to form an image in a direction opposite to a direction of the previous image formation.

After fixation by the fixing device 15, the discharge roller 62 again discharges the transfer sheet S after duplex printing to the discharge tray 60.

In order to increase efficiency of duplex printing, several sheets can simultaneously pass through the conveyance path. It is to be noted that a controller controls timing of image formation on both sides of the transfer sheet S.

A toner image formed on the photoconductor 2Y have a negative polarity. Thus, when the primary transfer roller 7Y is supplied with a positive polarity, the toner image formed on the photoconductor 2Y is transferred onto the surface of the intermediate transfer belt 6*a*.

When the secondary transfer roller 14*a* is supplied with a positive polarity, the toner image formed on the intermediate transfer belt 6*a* is transferred onto the transfer sheet S.

Although both the single-sided printing and the duplex printing form full color image as described above, in monochrome printing, the photoconductors 2Y, 2M, and 2C other than the photoconductor 2K are not used. In monochrome printing, the photoconductors 2Y, 2M, and 2C and the development devices 5Y, 5M, and 5C do not work. In addition, the printer 500 has a mechanism for separating the photoconductors 2Y, 2M, and 2C from the intermediate transfer belt 6*a*. The inner frame 6*f*, which supports the roller 6*d*, the primary transfer rollers 7Y, 7C, and 7M, can rotate around the frame shaft 6*g*. In monochrome printing, when the inner frame 6*f* rotates to move in a clockwise direction in which the inner frame 6*f* separates from the photoconductors 2Y, 2M, and 2C, the photoconductor 2Y contacts the intermediate transfer belt 6*a* to form a monochrome-image with black toner. Therefore, separation of the photoconductors 2Y, 2M, and 2C of the image forming units 1Y, 1M, and 1C not used in monochrome printing from the intermediate transfer belt 61 to cause the photoconductors 2Y, 2M, and 2C and the development devices 5Y, 5M, and 5C to stop operation is effective for longer useful life of the image forming units 1Y, 1M, and 1C.

When the printer 500 needs maintenance or replacement of components, an exterior cover or the like opens. Replacement of a process cartridge combining respective members constituting the image forming unit 1Y as a single unit facilitates maintenance.

When the image forming unit 1Y is formed as a process cartridge, provision of a guide or a handle can facilitate removal and attachment of the image forming unit 1Y to the printer 500. In addition, provision of a storage device, for example, an IC (Integrated circuit) tag, or the like, for storing a characteristic of the process cartridge or operating conditions serves as a guideline for maintenance of the process cartridge, thereby improving convenience of maintenance of the process cartridge.

Moreover, in maintenance and replacement of the intermediate transfer unit 6 depicted in FIG. 1, the intermediate transfer belt 6*a* may separate from each of the photoconductors 2Y, 2M, 2C, and 2K to pull out the intermediate transfer unit 1Y from the body of the printer 500.

Figure 3:
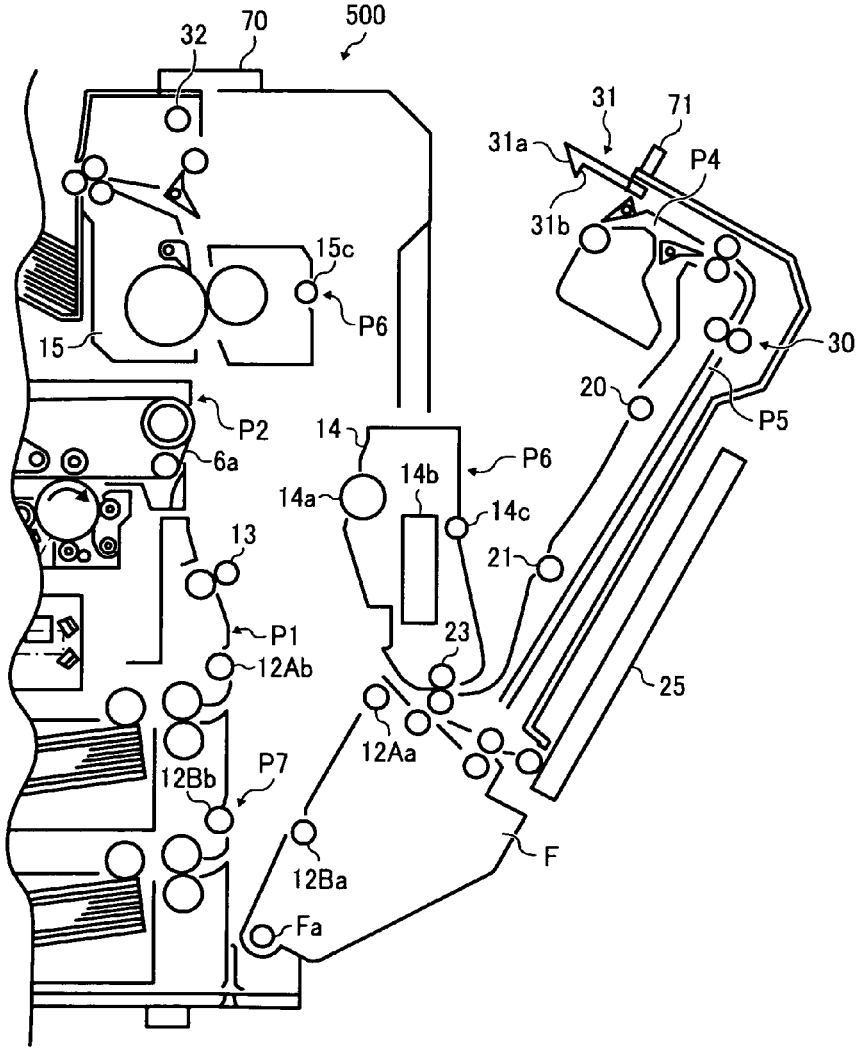
FIG. 3 is a schematic partial view of the printer and a duplex unit included in the printer shown in FIG. 1.

Referring to FIG. 3, a description is now given of structure of the side frame F. FIG. 3 is a schematic sectional view of the printer 500 and the side frame F. The frame F further includes a stopper 31 including a guide 31*a* and a stopper surface 31*b*, and the engagement projection 71. The printer 500 further includes a blocking member 32.

The duplex unit 30 and the secondary transfer unit 14 are provided in the side frame F. The side frame F is rotatable relative to the printer 500 around the rotation shaft Fa as a rotation center provided in a lower portion of the frame F. When the side frame F rotates, an upper portion of the frame F is open, as illustrated in FIG. 3. Before the frame F opens, a locking lever cause the stopper 31 provided in the side frame F to rotate to release from the blocking member 32 provided in the printer 500. When the side frame F opens, a plurality of conveyance paths including the feeding path P1, the conveyance path P2, and the re-feeding path P are accessible to a user, thereby facilitating treatment of a jammed transfer sheet S in these conveyance paths.

The secondary transfer unit 14 provided with the conveyance path P2 and the switch back path P5 formed on both sides of a housing of the secondary transfer unit 14 rotates around the roller 23. When the side frame F opens, the secondary transfer roller 14*a* separates from the intermediate transfer belt 6*a*. In addition, the secondary transfer unit 14 rotates such that the roller 14*c* separates from the roller 21. The secondary transfer unit 14 provided with the power source 14*b* inside the secondary transfer unit 14 conveys a transfer sheet S.

The fixing device 15 includes the conveyance roller 15*c* and a guide surface. One part of the conveyance roller 15*c* and the guide surface form the re-feeding path P6. The fixing device 15 can be pulled out from inside the printer 500 to the right side of the printer 500 in a state of FIG. 3, thereby facilitating treatment of paper jam occurring inside the fixing device 15.

The engagement projection 71 serving as a member to be engaged is provided on the upper surface of the side frame F, and engages an engagement portion of the assist mechanism 70, described later, when the side frame F moves in a closing direction so as to install the secondary transfer unit 14 and the duplex unit 30 in the printer 500. When the engagement projection 71 engages the engagement portion of the assist mechanism 70, the assist mechanism 70 pulls the side frame F to the printer 500. As the assist mechanism 70 pulls the frame F, the guide 31*a* of the stopper 31 contacts the blocking member 32. When the stopper 31 rotates to pass over the blocking member 32 due to the pulling force of the assist mechanism 70, the side frame F closes, so that the secondary transfer unit 14 and the duplex unit 30 are installed in a predetermined position.

The conveyance roller 15*c* is pressed against the roller 20 with a spring, and the conveyance roller 14*c* is pressed against the roller 21 with a spring. One roller 12Ab of the pair of conveyance rollers 12A provided in the printer 500 is pressed against another roller 12Aa provided in the side frame F with a spring. One roller of the pair of conveyance roller 12Bb provided in the printer 500 is pressed against a roller 12Ba provided in the side frame F with a spring.

As a result, when the side frame F is in a closed position, as illustrated in FIG. 1, the conveyance roller 15*c*, the conveyance roller 14*c*, the rollers 12Ab and 12Bb, serving as a pressing device, which are provided in the printer 500, press the side frame F in a direction of opening the side frame F. Accordingly, the stopper surface 31*b* of the stopper 31, serving as a stopper mechanism, contacts the blocking member 32 to properly define a position of the side frame F. That is, the conveyance roller 15*c*, the conveyance roller 14*c*, the rollers 12Ab and 12Bb provided in the printer 500 function as a pressing member of a positioning device.

Figure 4:
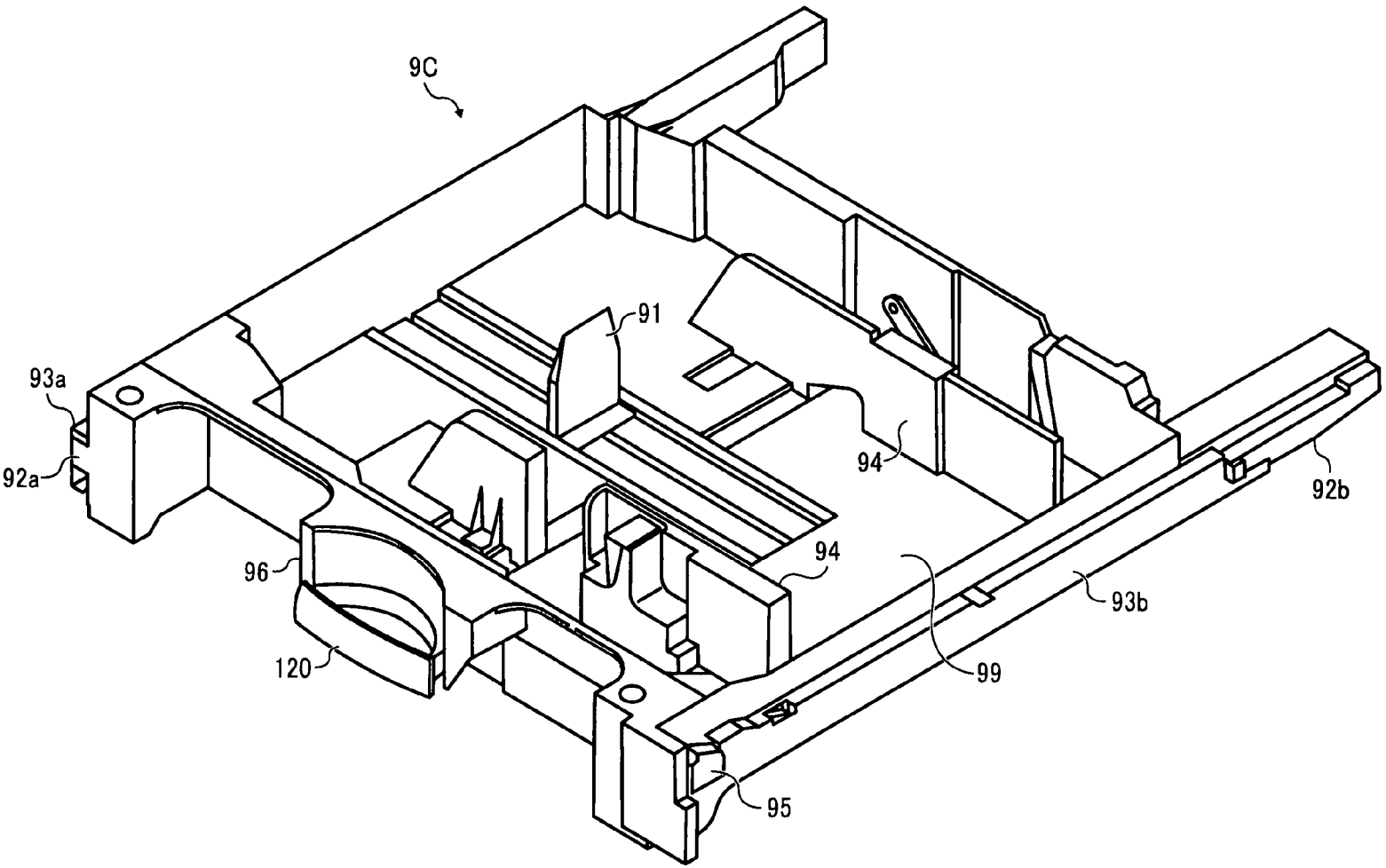
FIG. 4 is a perspective view of a paper tray included in the printer shown in FIG. 1.
Figure 5:
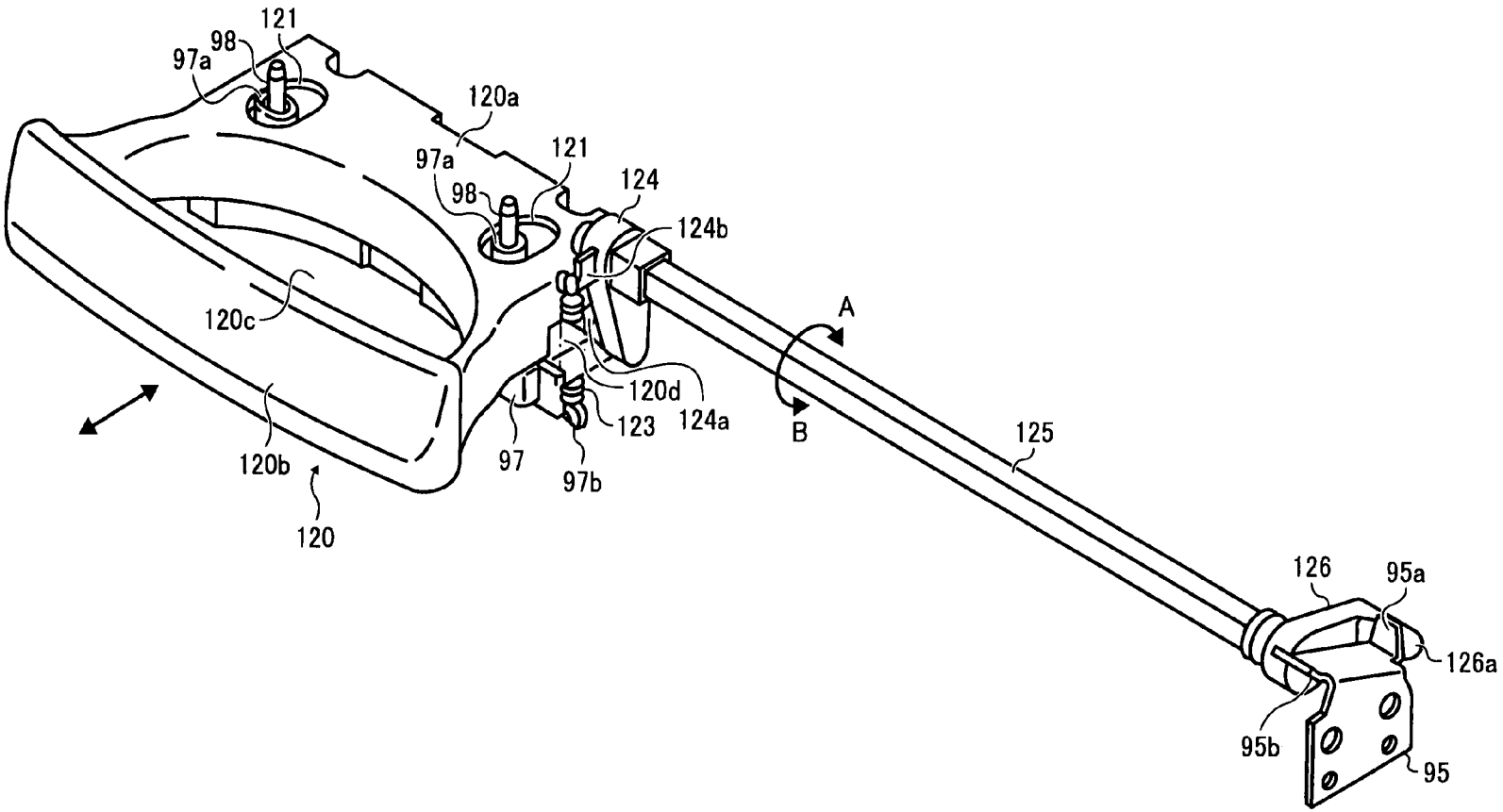
FIG. 5 is a perspective view of a handle and a stopper mechanism included in the paper tray shown in FIG. 4.
Figure 6A:
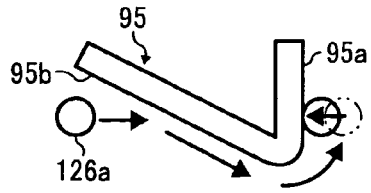
FIG. 6A is a schematic sectional view of the stopper mechanism shown in FIG. 5.

Referring to FIGS. 4, 5, and 6A, a description is now given of a structure of the paper tray 9C of the second feed device 50. FIG. 4 is a schematic perspective view of the paper tray 9C. It is to be noted that the paper trays 9A, 9B, and 9D have a structure similar to that of the paper tray 9C, serving as a retractable unit. The paper tray 9C includes concave portions 92*a* and 92*b*, guide rails 93*a* and 93*b*, a bottom plate 99, a fence 91, side guides 94L and 94R, a blocking member 95, a supporter 96 including a handle 120.

The concave portions 92*a* and 92*b* are provided on both sides of the paper tray 9C, protruding from side surfaces thereof, respectively. The concave portion 92*a* is supported by the guide rail 93*a* provided in the second feed device 50, and the concave portion 92*b* is supported by the guide rail 93*b* provided in the feed device 50. The paper tray 9C can be pulled out from the feed device 50 to the front side in a direction perpendicular to a direction of conveyance of the transfer sheet S, that is, the front side of the feed device 50, and can be stored in the feed device 50.

The bottom plate 99, the fence 91, the side guides 94L and 94R are provided inside the paper tray 9C. The bottom plate 99 presses up the transfer sheet S stored in the paper tray 9C. The fence 91 guides the rear of the transfer sheet S. The pair of side guides 94L and 94R guides both sides of the transfer sheet S in the width direction thereof. The blocking member 95 is attached to the front end portion of the guide rails 93*a* and 93*b* to define a position of the paper tray 9C.

The supporter 96 is provided in the central portion of the front of the paper tray 9C, and attached with the handle 120. The handle 120 is supported by the supporter 96 and movable in a direction of attachment and removal of the paper tray 9C, whereas the supporter 96 prevents movement of the handle 120 in the width direction (front and back in a sheet feeding direction) and an upward direction. A covering member, described later, prevents movement of the handle 120 in a downward direction.

FIG. 5 is a perspective view of the handle 120 of the paper tray 9C when the paper tray 9C is installed in the printer 500 serving as an image forming apparatus. The handle 120 includes a base portion 120*a* including two elongated holes 121, a grip 120*b*, a gap 120*c* defined by and located between the base portion 120*a* and the grip 120*b*, a concave portion 120*d*, a covering member 97 including two bosses 97*a* and a hook 97*b*, a shaft 125, a lever 124 including a projection 124*a* and a hook 124*b*, a spring 123, an outer lever 126 including a stopper 126*a*. The blocking member 95 includes a blocking surface 95*a* and a guide surface 95*b*.

The covering member 97 is provided below the base portion 120*a*. Each boss 97*a* protrudes from the upper surface of the covering member 97, and includes a through-hole penetrating in a vertical direction of the boss 97*a*. The elongated holes 121 are provided in the base portion 120*a* of the handle 120. The bosses 97*a* of the covering member 97 are inserted into the elongated holes 121. The elongated holes 121 of the handle 120 each have an outer diameter slightly greater than that of the bosses 97*a* in a direction perpendicular to a longitudinal direction of the elongated holes 121, so that the bosses 97*a* fit loosely in the elongated holes 121 with some play. An outer diameter of each of the elongated holes 121 in the longitudinal direction is greater than that of the bosses 97*a* by a predetermined length.

When the screw 98 is inserted in the upward direction into the through-hole of the boss 97*a*, the covering member 97 is fastened to the supporter 96 depicted in FIG. 4 positioned above the base portion 120*a* of the handle 120. Therefore, the base portion 120*a* of the handle 120 is sandwiched between the supporter 96 and the covering member 97, thereby attaching the handle 120 to the paper tray 9C. Accordingly, the handle 120 is movable in a direction indicated by a double-headed arrow shown at the left in FIG. 5, which is the direction of attachment and removal of the paper tray 9C. The range of movement of the handle 120 is defined by the elongated holes 121 and the bosses 97*a* of the covering member 97.

The shaft 125 is rotatably attached to the front of the paper tray 9C. The lever 124 is fixed to an end of the shaft 125 on the handle 120 side in a longitudinal direction thereof. The projection 124*a* is provided on a side surface of an edge of the lever 124, and fits into the concave portion 120*d* provided on a side surface of the handle 120. The hook 124*b* protrudes from a base portion of the lever 124. The spring 123 is provided between the hook 124*b* and the hook 97*b* provided in the covering member 97. When elastic force of the spring 123 is applied to the lever 124 to rotate in a direction B indicated by a double-headed arrow in FIG. 5, a side surface in the back of the projection 124*a* presses a side surface in the back of the concave portion 120*d*, so that the handle 120 is pressed in a direction of attachment of the paper tray 9*a* (toward the back of the printer 500). When the handle 120 is pulled toward the front of the printer 500 (in the direction of removal of the paper tray 9C) against the pressing force of the spring 123, the side surface in the back of the concave portion 120*d* presses the side surface in the back of the projection 124*a* to rotate the lever 124 (and the shaft 125) in a direction A, indicated by the double-headed arrow.

The outer lever 126 is fixed to the opposite end of the shaft 125 in the longitudinal direction of the shaft 125. The stopper 126*a* is provided at the edge of the outer lever 126, protruding in a direction of the side surface of the paper tray 9C.

The lever 124 and the outer lever 126 are attached to the shaft 125 at predetermined different angles that differ from each other by, for example, 90 degrees. Therefore, when the lever 124 is directed in the downward direction, as illustrated in FIG. 5, the outer lever 126 is directed toward the back of the paper tray 9C. When the paper tray 9C is attached to the feed device 50, the stopper 126*a* of the outer lever 126 contacts the blocking surface 95*a* of the blocking member 95 and protrudes from the upper surface in the back of the blocking member 95, as illustrated in FIG. 5.

When the paper tray 9C is attached to the feed device 50, a pressing member, described later, presses the paper tray 9C toward the front of the feed device 50 (the direction of removal of the paper tray 9C) and the stopper 126*a* of the outer lever 126 contacts the blocking surface 95*a* of the blocking member 95, thereby properly defining a position of the paper tray 9C in the front-back direction, as well as attaching the paper tray 9C to the feed device 50.

Then, when the handle 120 is pulled to the front of the feed device 50, the lever 124, the shaft 125, and the outer lever 126 rotate in the direction A, respectively, to rotate the stopper 126*a* of the outer lever 126 in the downward direction to separate from the blocking surface 95*a*, thereby releasing a stopper function of a stopper mechanism including the stopper 126*a* and the blocking member 95. In addition, when a back wall portion of the elongated hole 121 contacts the boss 97*a* of the covering member 97 to press the boss 97*a*, the paper tray 9C is pulled out from the feed device 50.

FIG. 6A illustrates operation of the stopper mechanism. In attachment of the paper tray 9C, the stopper 126*a* of the outer lever 126 contacts the guide surface 95*b* of the blocking member 95. When the paper tray 9C is inserted into the feed device 50, the stopper 126*a* is pressed against the guide surface 95*b* and moves downwards (the outer lever 126 rotates in the direction A of FIG. 5). That is, as the paper tray 9C is inserted into the feed device 50, the stopper 126*a* moves along the guide surface 95*b* and passes over a bottom (a corner) of the guide surface 95*b*. Since the outer lever 126 rotates in the direction B of FIG. 5 due to the pressing force of the spring 123, the stopper 126*a* contacts the blocking member 95*a* to function as a stopper mechanism.

Figure 7:
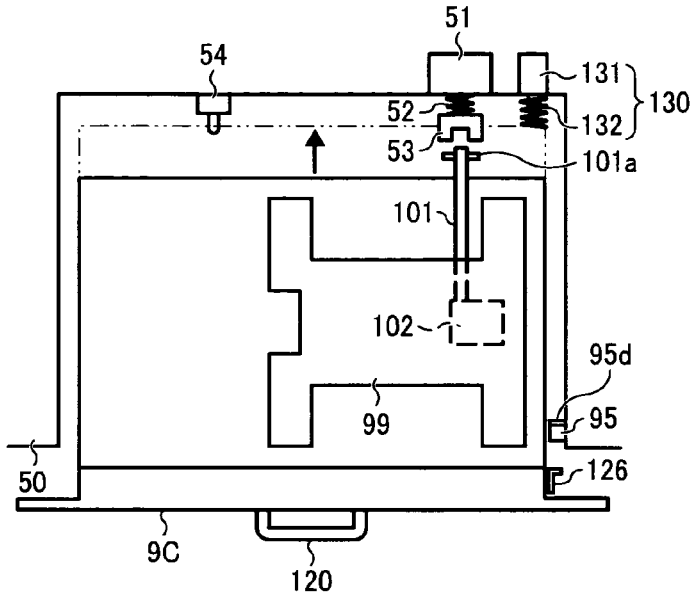
FIG. 7 is a plan view of a feed device included in the printer shown in FIG. 1 and the paper tray shown in FIG. 4.
Figure 8:
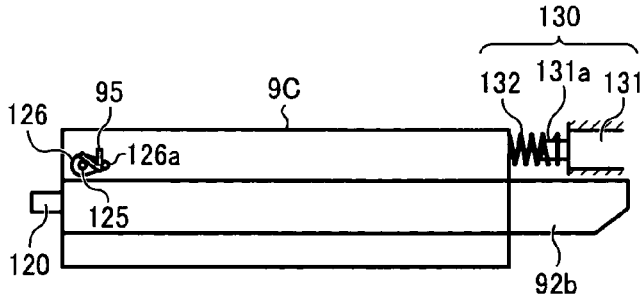
FIG. 8 is a side view of the paper tray shown in FIG. 7.

FIG. 7 is a schematic plan view of the paper tray 9C installed in the feed device 50. The feed device 50 includes a motor 51, a spring 52, a coupling 53, a detector 54, and a pressing device 130 including a solenoid 131 and a compression spring 132. The paper tray 9C further includes a rotary shaft 101 including a projection 101*a*, and a pressing member 102. FIG. 8 is a schematic side view of the paper tray 9C and the pressing member 130. As can be seen in FIG. 8, the solenoid 131 includes an arm 131*a*.

The coupling 53 transmits a driving force from the motor 51 to the paper tray 9C. The spring 52 winds around an output shaft of the motor 51 to press the coupling 53 toward the paper tray 9C. When the motor 51 outputs a driving force, the motor 51 is movable vertically in a direction of an axis thereof, so that the coupling 53 attached to the edge of the output shaft is movable in a direction of retraction of the paper tray 9C. The rotary shaft 101 is provided in the paper tray 9C. The projection 101*a* is provided at the back end of the rotary shaft 101 to engage the coupling 53. The pressing member 102 is fixed at the opposite end of the rotary shaft 101. When the pressing member 102 presses against and lifts the bottom plate 99 to press a transfer sheet S against the feed roller 10C depicted in FIG. 1, the transfer sheet S can be fed from the feed device 50.

The detector 54 detects attachment of the paper tray 9C to the feed device 50. The arm 131*a* depicted in FIG. 8 of the solenoid 131 is movable in a direction of removal and attachment of the paper tray 9C. The compression spring 132 is attached to the top of the arm 131*a*. The pressing device 130 supplies a pressing force to the paper tray 9C to move in the direction of retraction of the paper tray 9C. The solenoid 131 as a pressing member can turn the pressing force on and off. The pressing device 130 supplies a pressing force in a direction in which the blocking surface 95*a* of the blocking member 95 contacts the stopper 126 (the direction of removal of the paper tray 9C).

When the detector 54 detects that the paper tray 9C is attached to the feed device 50, the solenoid 131 is turned on to move the arm 131*a* forward, so that the compression spring 132 contacts the back wall of the paper tray 9C to press the paper tray 9C, thereby moving the paper tray 9C in the direction of removal of the paper tray 9C, that is, the paper tray 9C is pressed toward the front of the feed device 50. When doing so, when the stopper 126*a* indicated by broken line moves to the blocking surface 95*a*, as illustrated in FIG. 6A, the solenoid 131 presses the paper tray 9C back to cause the stopper 126*a* to contact the blocking surface 95*a* depicted in FIG. 5, thereby positioning the paper tray 9C in the direction of attachment and removal of the paper tray 9C (that is, the front-back direction of the printer 500, which is the direction perpendicular to the direction of conveyance of sheet). It is to be noted that the solenoid 131 has a pressing force greater than a force sufficient to move the paper tray 9C loaded with transfer sheets S to a stopper position (position at which the stopper 126*a* contacts the blocking surface 95*a*).

Conversely, when the detector 54 detects that the paper tray 9C is pulled out from the feed device 50, the solenoid 131 is turned off to move the arm 131*a* back, so that the compression spring 132 also moves back to a retraction position at which the top of the compression spring 132 does not contact the paper tray 9C. Therefore, by positioning the compression sprint 132 at the retraction position when the paper tray 9C is pulled out from the feed device 50, the compression sprint 132 does not block insertion of the paper tray 9C.

Alternatively, when the solenoid 131 has a holding function of keeping the arm 131*a* in a position where the arm 131*a* moves forward even when not powered, the solenoid 131 may be turned off after the paper tray 9C moves to the stopper position in attachment of the paper tray 9C. When the detector 54 detects that the paper tray 9C is pulled out from the feed device 50, the solenoid 131 may be turned on to move the arm 131*a* backward and then turned off.

The detector 54 depicted in FIG. 7 can be a mechanical detector such as a push switch or the like, an optical detector such as a photosensor, or the like. According to this example embodiment, the pressing device 130 uses the solenoid 131 as a pressing member for moving the paper tray 9C to the stopper position. Alternatively, the pressing device 130 may use other suitable structures that employ a motor or the like. Moreover, although the detector 54 and the solenoid 131 as a paper tray pressing member may be installed in the paper tray 9C, they must have a structure that enables power to be supplied.

In addition, the pressing device 130 for positioning the paper tray 9C (for pressing the stopper 126*a* against the blocking surface 95*a*) may be formed of an elastic member such as a spring or the like, so that the feed device 50 does not need the detector 54, resulting in cost reduction.

Referring once again to FIG. 6A, a description is given of operations of the stopper 126*a* of the outer lever 126 and the blocking member 95. FIG. 6A illustrates the stopper 126*a* and the blocking member 95 when the paper tray 9C is normally attached to the feed device 50. As described above, when the stopper 126*a* contacts the guide surface 95*b* of the blocking member 95, the outer lever 126 rotates to gradually move along the guide surface 95*b*, and when passing over the top (the corner) of the blocking member 95 moves back to return the stopper 126*a* to an original position. Even when the paper tray 9C is pulled out excessively, the solenoid 131 depicted in FIG. 7 as a pressing member returns the paper tray 9C, so that the stopper 126*a* contacts the blocking surface 95*a* of the blocking member 95, thereby properly positioning the paper tray 9C.

Referring again to FIGS. 7 and 8, a description is given of the relative positions of the pressing device 130 and the blocking member 95. As illustrated in FIG. 8, the compression spring 132 is provided at a height substantially equal to that of the blocking surface 95*a* of the blocking member 95 in a vertical direction of the feed device 50. As illustrated in FIG. 7, the compression spring 132 is provided at a position substantially equal to that of the blocking surface 95*a* in a width direction of the feed device 50. That is, an operating point of the pressing force of the solenoid 131 is positioned substantially equal to the blocking surface 95*a* of the blocking member 95 on a surface of projection. Alternatively, a bracket or the like may be attached to the paper tray 9C, so that the operating point of the pressing force of the solenoid 131 corresponds to the blocking surface 95*a* of the blocking member 95 on a surface of projection.

Therefore, since the pressing force of the solenoid 131 is applied to the blocking surface 95*a* in a direction of movement of the paper tray 9C, little moment is generated due to the pressing force of the paper tray 9C, so that the paper tray 9C does not incline when attached to the feed device 50, thereby efficiently positioning the paper tray 9C.

Figure 6B:
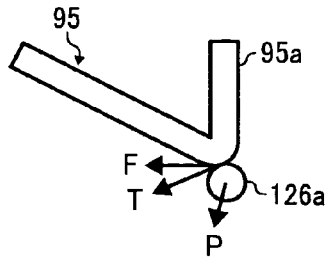
FIG. 6B is schematic sectional view of the stopper mechanism shown in FIG. 5.

Referring to FIG. 6B, a description is given of a condition of the stopper 126*a* when the paper tray 9C is improperly attached to the feed device 50. FIG. 6B is a sectional view of the stopper 126*a* and the blocking member 95.

When the solenoid 131 exerts only a limited pressing force to press the paper tray 9C against the blocking surface 95*a* due to assembly error or the like, that is, the pressing force is too little to press the paper tray 9C to the stopper position at which the stopper 126*a* contacts the blocking surface 95*a*, if the paper tray 9C is slowly inserted into the feed device 50, the stopper 126*a* is kept at a position as illustrated in FIG. 6B. Under such conditions, if the detector 54 erroneously determines that the paper tray 9C is completely attached to the feed device 50, the paper tray 9C may be pulled out from the feed device 50 during operation, causing a failure in paper feeding.

If the pressing device 130 for positioning the paper tray 9C (for pressing the blocking surface 95*a* against the stopper 126*a*) uses only an elastic member such as spring or the like, the feed device 50 does not need to include the solenoid 131 and the detector 54, thereby reducing cost thereof. However, it is impossible to turn on and off the pressing force or increase and decrease the pressing force of the spring, and thus, a user has to insert the paper tray 9C in the feed device 50 against the pressing force of the elastic member (that is, a force that pushes backward the paper tray 9C loaded with transfer sheets S). Therefore, the pressing force for positioning the paper tray 9C prevents attachment of the paper tray 9C, thereby decreasing usability thereof.

Accordingly, according to this example embodiment, in order not to create a situation like that illustrated in FIG. 6B or decrease the usability of the paper tray 9C, the printer 500 includes the assist mechanism 70 depicted in FIG. 1 for moving the paper tray 9C to be installed in the feed device 50.

Figure 9:
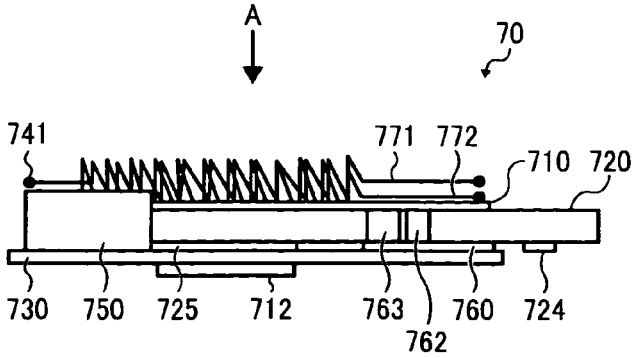
FIG. 9 is a side view of an assist mechanism included in the printer shown in FIG. 1.
Figure 10:
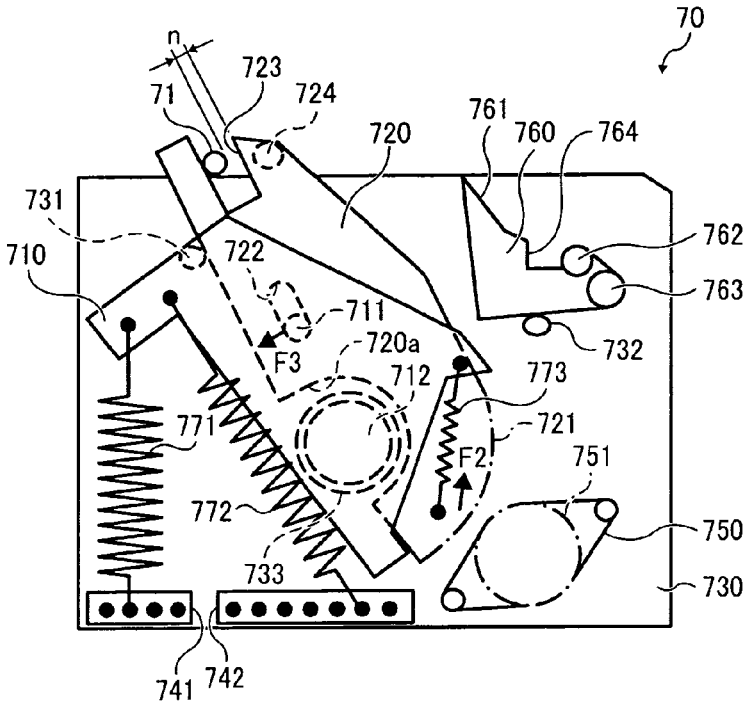
FIG. 10 is a top view of the assist mechanism shown in FIG. 9.

Referring to FIGS. 9 and 10, a description is now given of the structure of the assist mechanism 70. According to this example embodiment, the assist mechanism 70 is used for pulling the paper tray 9C as a single unit capable of being pulled out from the printer 500. However, this description is also applicable to a case in which the assist mechanism 70 is used for pulling the side frame F as a unit openably closable relative to the printer 500.

FIG. 9 is a side view of the assist mechanism 70. FIG. 10 is a top view of the assist mechanism 70 seen from a direction A of FIG. 9. As illustrated in FIG. 9, the assist mechanism 70 includes a base 730, a first lever 710, a second lever 720, a lock lever 760, a rotary damper 750, a first spring 771, a second spring 772, and a first spring adjuster 741. As illustrated in FIGS. 9 and 10, the lock lever 760 includes a rotary shaft 763, a moving projection 762, a blocking surface 764, and a release surface 761. As illustrated in FIG. 10, the assist mechanism 70 further includes an engagement hole 733, a second spring adjuster 742, and a connection spring 773. The first lever 710 includes an engagement boss 711, a rotary shaft 712. The second lever 720 includes an engagement slot 722, a curved portion 720*a*, an engagement portion 723, engagement teeth 721, a protruding portion 724, and a projection 725. The rotary damper 750 includes a rotary gear 751. The base 730 includes a release projection 731 and a controlling projection 732.

Referring once again to FIG. 1, the engagement projection 71, serving as an engagement member, is provided on the outside bottom surface of the paper tray 9C. The base 730 depicted in FIG. 9 is attached to the body of the feed device 50 depicted in FIG. 1. The rotary shaft 712 is provided in the first lever 710, serving as a first swingable member, and rotatably engages the engagement hole 733 provided substantially in a central portion of the base 730. As illustrated in FIG. 10, one end of the first spring 771 and one end of the second spring 772 are attached to the first lever 710 on the side of the engagement projection 71. Another end of the first spring 771 is attached to the first spring adjuster 741 provided on the base 730, whereas another end of the second spring 772 is attached to the second spring adjuster 742 provided on the base 730. The engagement boss 711 is provided on the first lever 710 on the side of the base 730 and on the side of the engagement projection 71 upstream from the rotary shaft 712.

The first spring adjuster 741, serving as a tension adjuster, includes a plurality of screw holes. Another end of the first spring 771 is fastened to one of the plurality of screw holes of the first spring adjuster 741 with a screw. By changing the screw hole used to fasten the first spring 771, the tension of the first spring 771 can be varied. Similarly, the second spring adjuster 742, serving as a tension adjuster, includes a plurality of screw holes. Another end of the second spring 772 is fastened to one of the plurality of screw holes of the second spring adjuster 742 with a screw. By changing the screw hole used to fasten the second spring 772, the tension of the second spring 772 can be varied. Therefore, since the first spring adjuster 741 and the second spring adjuster 742 can adjust tension of the first spring 771 and second spring 772, serving as pressing members, the assist mechanism 70 obtains a desired pulling force.

Alternatively, the first spring adjuster 741 and the second spring adjuster 742 may include a rail and a sliding member sliding on the rail. When another end of each of the first and second springs 771 and 772 is attached to the sliding member, by sliding the sliding member on the rail to adjust tension of the first and second springs 771 and 772, the assist mechanism 70 obtains a predetermined pulling force. Then, the sliding member is fixed to the rail.

As illustrated in FIG. 9, the second lever 720, serving as a second swingable member, is provided between the first lever 710, serving as a first swingable member, and the base 730.

The engagement slot 722 is provided on the second lever 720 to engage the boss 711 of the first lever 710. The projection 725 depicted in FIG. 9 is provided in the curved portion 720*a* depicted in FIG. 10 of the second lever 720 surrounding the rotary shaft 712 of the first lever 710 on a surface of the second lever 720 on the side of the base 730. As illustrated in FIG. 9, the projection 725 contacts the base 730 to form a gap having a thickness greater than that of the lock lever 760 between the base 730 and the second lever 720. The concave engagement portion 723, serving as a catch portion, depicted in FIG. 10 is provided in the second lever 720 to engage the engagement projection 71. As illustrated in FIG. 10, the engagement teeth 721 are provided in the second lever 720 to engage the rotary gear 751 of the rotary damper 750 provided on the base 730. The protruding portion 724 is provided in the second lever 720 on the right side of the engagement portion 723 of FIG. 10, and protrudes from the surface of the second lever opposing the base 730. As can be seen from FIG. 9, the protruding portion 724 of the second lever 720 has a height equal to that of the projection 725 of the second lever 720. As illustrated in FIG. 10, one end of the connection spring 773 is attached to a periphery of the engagement teeth 721 of the second lever 720, whereas another end of the connection spring 773 is attached to an end of the first lever 710 in a direction in which the first lever 710 is pulled out.

As illustrated in FIG. 10, when the paper tray 9C is installed in a predetermined position of the feed device 50 depicted in FIG. 1 (when the engagement projection 71 is pulled in), the release projection 731 of the base 730 contacts an edge surface of the second lever 720. The engagement teeth 721 of the second lever 720 separate from the rotary gear 751. Under such conditions, a force F3 of the first lever 710 (the resultant force of the first spring 771 and the second spring 772) rotating the second lever 720 in a clockwise direction around a contact position with the release projection 731 via the boss 711 equals a force F2 of the connection spring 773 rotating the second lever 720 in a counterclockwise direction around the contact position with the release projection 731.

The engagement portion 723 is larger than a diameter of the engagement projection 71, so that a predetermined amount of play or clearance n is enabled between the engagement portion 723 and the engagement projection 71 when the paper tray 9C is installed in the feed device 50. If the clearance n is too small, when the pressing device 130 depicted in FIG. 7 presses the paper tray 9C to pull out the paper tray 9C, the engagement projection 71 contacts a side surface of the engagement portion 723 in a direction in which the paper tray 9C is pulled out and the pressing force of the pressing device 130 cannot move the paper tray 9C to be pulled out from the feed device 50, so that the stopper 126*a* depicted in FIG. 5 cannot contact the blocking surface 95*a* of the blocking member 95, thereby preventing the paper tray 9C from being properly positioned in the feed device 50. Therefore, the clearance n between the engagement portion 723 and the engagement projection 71 is set such that the stopper 126*a* contacts the blocking surface 95*a* of the blocking member 95.

The rotary shaft 763 of the lock lever 760 is rotatably attached to the base 730, and contacts the controlling projection 732 provided on the base 730 when the paper tray 9C is installed in the feed device 50 (when the engagement projection 71 is pulled in).

Figure 11:
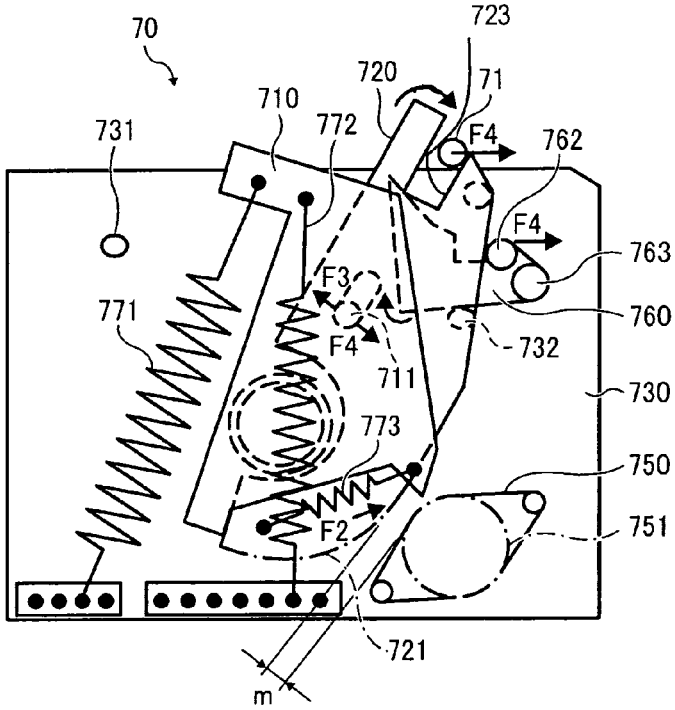
FIG. 11 is a top view of the assist mechanism shown in FIG. 9.
Figure 12:
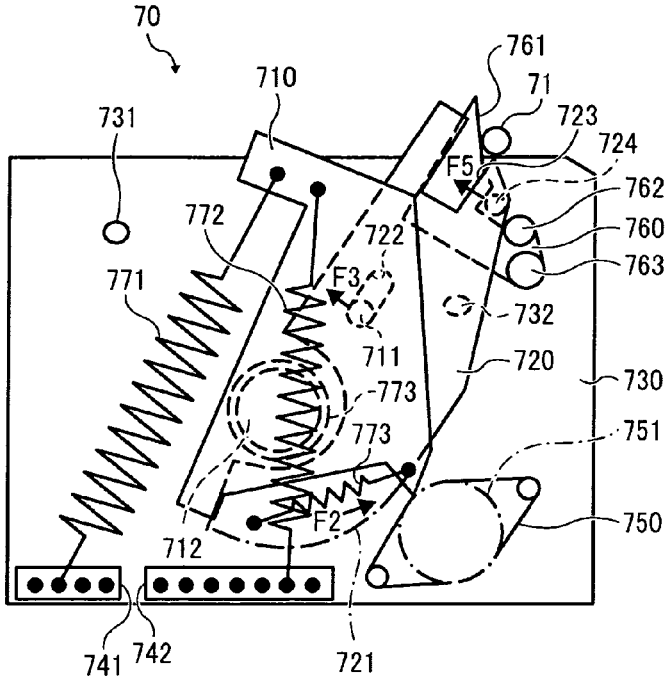
FIG. 12 is a top view of the assist mechanism shown in FIG. 9.

Referring to FIGS. 10, 11, and 12, a description is now given of an operation of the assist mechanism 70 when the paper tray 9C is pulled out from the feed device 50, that is, the paper tray 9C is moved to an open position. FIG. 11 is a schematic top view of the assist mechanism 70 when the paper tray 9C is pulled out from the feed device 50, that is, the paper tray 9C is moved to a closed position. FIG. 12 is a schematic top view of the assist mechanism 70 after the paper tray 9C is pulled out from the feed device 50.

When the paper tray 9C begins to be pulled out, the engagement projection 71 contacts the side surface of the engagement portion 723 of the second lever 720 in the direction in which the paper tray 9C is pulled out to press the engagement portion 723 of the second lever 720 in the pulling-out direction. Then, as illustrated in FIG. 11, a force F4 is transmitted to the first lever 710 via the engagement boss 711 of the first lever 710 to press the side surface of the engagement portion 723 of the second lever 720 in the pulling-out direction. Since the force F4 is greater than the force F3 (the resultant force of the first spring 771 and the second spring 772) of the first lever 710, the first lever 710 together with the second lever 720 rotates around the rotary shaft 712 in the clockwise direction. In addition, since the force F4 is greater than the force F2 of the connection spring 773 rotating the second lever 720 in the counterclockwise direction, the second lever 720 rotates counterclockwise, with the engagement teeth 721 separated from the rotary gear 751. Therefore, when the paper tray 9C is pulled out from the feed device 50, a gap m is formed between the engagement teeth 721 of the second lever 720 and the rotary gear 751 of the rotary damper 750. Accordingly, no load is applied to the paper tray 9C by the rotary damper 750 when the paper tray 9C is pulled out from the feed device 50. As a result, the force F3 (the resultant force of the first spring 771 and the second spring 772) resists the pulling force of the paper tray 9C, so that the paper tray 9C can be smoothly pulled out from the feed device 50.

When the first lever 710 together with the second lever 720 rotates clockwise to move the engagement projection 71 in the pulling-out direction, a side surface of the second lever 720 in the pulling-out direction contacts the moving projection 762 of the lock lever 760, as illustrated in FIG. 11. Then, the second lever 720 presses the moving projection 762 of the lock lever 760 in the pulling-out direction. As a result, the lock lever 760 rotates clockwise around the rotary shaft 763. As illustrated in FIG. 12, when the engagement projection 71 is disengaged from the engagement portion 723 of the second lever 720, the blocking surface 764 of the lock lever 760 is positioned to the left side of the protruding portion 724 of the second lever 720 in the direction of attachment of the paper tray 9C.

Moreover, when the engagement projection 71 is disengaged from the engagement portion 723 of the second lever 720, a force F5 is generated to rotate the second lever 720 counterclockwise. The force F5 is a resultant force of the pulling force F3 (the resultant force of the first spring 771 and the second spring 772) of the first lever 710 and the force F2 of restitution of the connection spring 773. However, contact between the protruding portion 724 and the blocking surface 764 of the lock lever 760 positioned to the left side of the protruding portion 724 of the second lever 720 in the direction of attachment of the paper tray 9C prevents counterclockwise rotation of the second lever 720, thereby keeping the first and the second levers 710 and 720 in positions indicated in FIG. 12.

Figure 13:
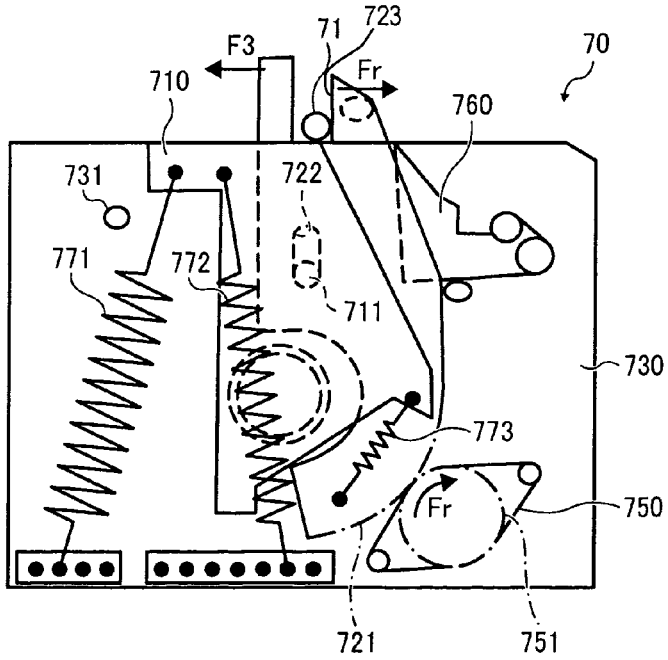
FIG. 13 is a top view of the assist mechanism shown in FIG. 9.

Referring to FIGS. 10, 12, 13, 14, 15A, 15B, and 16, a description is now given of operation of the assist mechanism 70 in attachment of the paper tray 9C. FIG. 13 is a schematic top view of the assist mechanism 70 when the paper tray 9C is pulled back into the feed device 50.

When the paper tray 9C is inserted into the feed device 50, the engagement projection 71 contacts the release surface 761 of the lock lever 760, as illustrated in FIG. 12. When the paper tray 9C further moves in the direction of attachment of the paper tray 9C, the release surface 761 of the lock lever 760 is pressed by the engagement projection 71 to rotate the lock lever 760 around the rotary shaft 763 in the counterclockwise direction, thereby releasing the second lever 720 to rotate counterclockwise, so that the engagement projection 71 engages the engagement portion 723 of the second lever 720. As a result, due to the pulling force F3 (the resultant force of the first spring 771 and the second spring 772), the second lever 720 together with the first lever 710 rotates counterclockwise. In addition, due to the force F2 of restitution of the connection spring 773, the second lever 720 moves clockwise relative to the first lever 710. When the engagement teeth 721 engage the rotary gear 751, as illustrated in FIG. 13, the rotary damper 750 supplies the second lever 720 with torque Fr. Therefore, when the paper tray 9C has a small total weight due to a small number of sheets stored in the paper tray 9C, the paper tray 9C is supplied with a decreased sliding load to increase the speed of the pulling force F3, thereby increasing the torque Fr of the rotary damper 750, so that the paper tray 9C is pulled back into the feed device 50 at a decreased speed. Conversely, when the paper tray 9C has a great total weight due to a large number of sheets stored in the paper tray 9C, the paper tray 9C is supplied with an increased sliding load to decrease the speed of the pulling force F3, so that the torque Fr of the rotary damper 750 is decreased, thereby preventing the paper tray 9C from being pulled back into the feed device 50.

Figure 14:
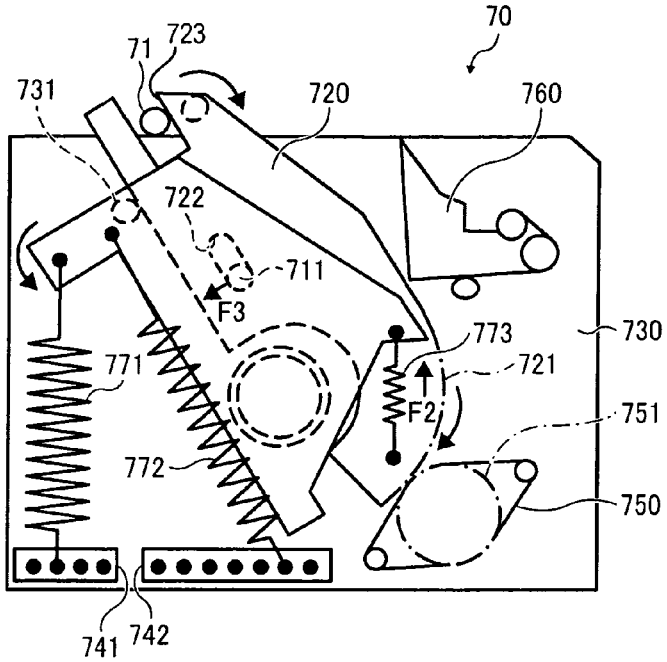
FIG. 14 is a top view of the assist mechanism shown in FIG. 9.

Accordingly, when the rotary damper 750 causes the paper tray 9C to be pulled into the feed device 50 at a constant speed, as illustrated in FIG. 14, a side surface of the second lever 720 on the side of attachment of the paper tray 9C contacts the release projection 731. Then, due to the force F3 (the resultant force of the first spring 771 and the second spring 772) of the engagement boss 711 of the first lever 710 pressing the second lever 720, the second lever 720 rotates clockwise around the release projection 731. Then, the engagement teeth 721 of the second lever 720 separate from the rotary gear 751 of the rotary damper 750. In addition, the connection spring 773 stretches to generate the force F2 of restitution. When the force F2 of restitution of the connection spring 773 equals the resultant force F3 of the first spring 771 and the second spring 772, the second lever 720 stops rotating, returning to the state of FIG. 10.

According to this example embodiment, when the paper tray 9C is attached to the feed device 50, the second lever 720 contacts the release projection 731, serving as a release member, to rotate the second lever 720 relative to the first lever 710 in a direction opposite to the pulling-in direction of the paper tray 9C. Therefore, a force pulling the engagement projection 71 is released, so that the pressing force of the pressing device 130 depicted in FIG. 7 is applied to the paper tray 9C to be pulled out from the feed device 50. As a result, the stopper 126*a* depicted in FIG. 5 contacts the blocking surface 95*a* of the blocking member 95, thereby properly defining a position of the paper tray 9C.

In addition, according to this example embodiment, by using the assist mechanism 70, the paper tray 9C can be properly attached to the feed device 50. Therefore, even when the pressing device 130 has a little pressing force to press the paper tray 9C to the blocking surface 95*a* due to assembly error, or the like, the paper tray 9C can be firmly installed in the feed device 50, thereby preventing the paper tray 9C from pulling out from the feed device 50 in working condition.

Since the assist mechanism 70 automatically pulls the paper tray 9C to a predetermined attachment position, even when the pressing device 130 is an elastic member such as a spring or the like, due to a force of the elastic member such as a spring or the like pulling out the paper tray 9C from the feed device 50, the paper tray 9C can be automatically pulled into the feed device 50, thereby increasing its usability.

Moreover, according to this example embodiment, the plurality of pressing members, that is, the first spring 771 and the second spring 772, generates the pulling force F3. If a single pressing member generates a pulling force, as the paper tray 9C is pulled into the feed device 50, the pulling force is reduced. Therefore, when the force F3 is generated in the vicinity of the feed device 50, in order to pull the paper tray 9C into the feed device 50, a spring with a large spring modulus needs to be used. If a spring with a large spring modulus is provided, the assist mechanism 70 is in the condition as indicated in FIG. 12, the first lever 710, a base 730, a lock lever 760, and the like, are subjected to substantial stress, causing damage or deformation thereof.

Figure 15A:
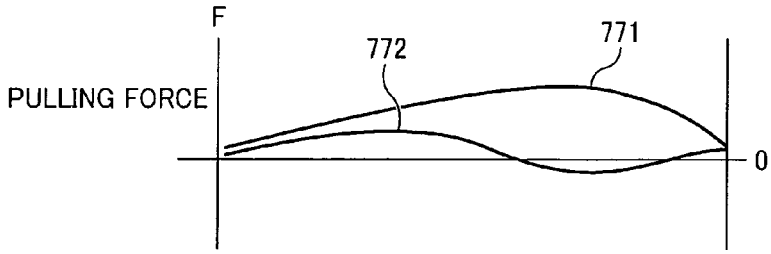
FIG. 15A is a graph illustrating pulling forces of first and second springs from start to finish of pulling the paper tray shown in FIG. 4.
Figure 15B:
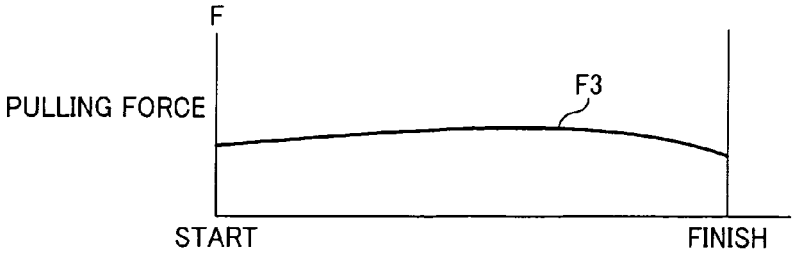
FIG. 15B is a graph illustrating the resultant of the pulling forces of the first and the second springs from start to finish of pulling the paper tray shown in FIG. 4.

FIG. 15A is a graph illustrating pulling forces of the first and the second springs 771 and 772 from start to finish of pulling the paper tray 9C. FIG. 15B is a graph illustrating the resultant of the pulling forces of the first and the second springs 771 and 772 from start to finish of pulling the paper tray 9C.

According to this example embodiment, since the plurality of pressing members, that is, the first spring 771 and the second spring 772, generates the pulling force F3, the paper tray 9C can be pulled by a substantially uniform force from start to finish of pulling the paper tray 9C, as illustrated in FIG. 15B. That is, as illustrated in FIG. 15A, when the first spring 771 generates a maximum pulling force (force rotating the first lever 710 counterclockwise), the second spring 772 generates a force reducing the pulling force of the first spring 771 (force rotating the first lever 710 clockwise), thereby pulling the paper tray 9C with a substantially uniform force from start to finish of pulling the paper tray 9C. Therefore, compared to a case of using a single pressing member, use of the plurality of pressing members, that is, the first spring 771 and the second spring 772, generates the pulling force F3 that can prevent damage to components of the feed device 50.

According to this example embodiment, the pressing device 130 uses an elastic member such as a spring. Alternatively, the pressing device 130 may use an elastic member such as a plate spring, rubber, resin, or the like.

Figure 16:
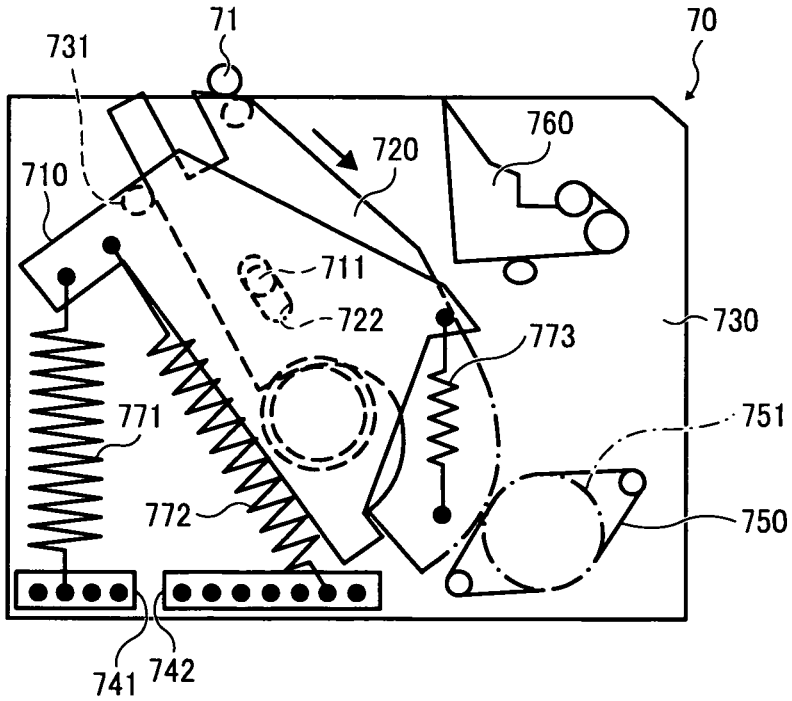
FIG. 16 is a top view of the assist mechanism shown in FIG. 9.

Moreover, when the paper tray 9C is pulled out from the feed device 50, when a user presses the lock lever 760 by mistake, the second lever 720 is unlocked, so that the first lever 710 and the second lever 720 rotate and swing to the attachment position. Under such conditions, when the paper tray 9C moves in the direction of attachment of the paper tray 9C, the engagement projection 71, serving as an engagement member, contacts the side surface of the second lever 720 other than the engagement portion 723, serving as a catch portion, in the pulling-out direction. However, according to this example embodiment, since the engagement boss 711 of the first lever 710 engages the engagement slot 722 of the second lever 720, the second lever 720 escapes from a line of movement of the engagement projection 71. Therefore, when the engagement projection 71 contacts the side surface of the second lever 720 other than the engagement portion 723 in the pulling-out direction, the paper tray 9C is further pressed in the direction of attachment of the paper tray 9C, as illustrated in FIG. 16, the second lever 720 escapes from the line of movement of the engagement projection 71 to move the paper tray 9C in the attachment direction. Thus, even if the lock lever 760 is unlocked when the paper tray 9C is pulled out from the feed device 50, the paper tray 9C can be attached to the feed device 50. Then, when the engagement projection 71 passes over a portion of the second lever 720 in the pulling-out direction and engages the engagement portion 723, the second lever 720 moves toward the line of movement of the engagement projection 71 due to the elastic force of the connection spring 773, as illustrated in FIG. 10.

When the assist mechanism 70 is provided in a self-closing mechanism of the side frame F, the side frame F including the secondary transfer unit 14, the duplex unit 30, or the like is heavier than the paper tray 9C. Therefore, when the assist mechanism 70 is provided in a self-closing mechanism of the side frame F, in order to properly pull the side frame F, the pulling force F3 is adjusted by changing a position of attachment of the first spring 771 to the first spring adjuster 741 or a position of attachment of the second spring 772 to the second spring adjuster 742. Thus, according to this example embodiment, since the assist mechanism 70 can adjust a pulling force as appropriate for the unit to be moved, the assist mechanism 70 can properly pull various units.

According to this example embodiment, the assist mechanism 70 is used for pulling the paper tray 9C. Alternatively, however, the assist mechanism 70 may be used for attachment of a process cartridge, for example, the image forming unit 1Y, when a spent process cartridge is removed from the body of the printer 500 by opening an exterior cover, or the like and a new process cartridge is attached to the body of the printer 500 by sliding it from front to back. Alternatively, in replacement of the toner bottles 40Y, 40M, 40C, and 40K, the assist mechanism 70 may be used for attachment of the toner bottles 40Y, 40M, 40C, and 40K.

According to this example embodiment, the assist mechanism 70 includes a release mechanism, that is, the release projection 731 depicted in FIG. 10, for releasing a force pulling the paper tray 9C depicted in FIG. 1 into the feed device 50. Therefore, when the paper tray 9C is pulled into a predetermined position of the feed device 50 by the pulling force, the release projection 731, serving as a release member, releases the pulling force, so that no pulling force acts on the paper tray 9C attached to the feed device 50. Therefore, the stopper 126*a* depicted in FIG. 5 can contact the blocking member 95 depicted in FIG. 5 by the pressing force of the pressing device 130 depicted in FIG. 7, thereby properly positioning the paper tray 9C.

According to this example embodiment, when the assist mechanism 70 pulls the openably closable side frame F depicted in FIG. 3 to an installation position, the release projection 731 releases the force pulling the side frame F to the installation position. Therefore, a pressing member supplies a force pressing a roller, for example, the rollers 12Aa and 12Ba depicted in FIG. 3, provided in the duplex unit 30, or the like, to cause the side frame F to rotate to open, so that the stopper surface 31*b* of the stopper 31 contacts the blocking member 32 to properly define a position of the side frame F. Therefore, the pair of conveyance rollers 12A and 12B depicted in FIG. 1 can maintain an appropriate nip pressure therebetween, thereby properly conveying a transfer sheet S.

According to this example embodiment, the assist mechanism 70 includes the first lever 710, swingable relative to the assist mechanism 70 and pressed by the first spring 771 and the second spring 772 in a direction of pulling the paper tray 9C into the feed device 50, and the second lever 720, having the engagement portion 723 and supported by the first lever 710 and swingable relative to the first lever 710. The assist mechanism 70 also includes the release projection 731 contacting the second lever 720 when the paper tray 9C is pulled into the feed device 50 to cause the second lever 720 to swing in a direction opposite to the direction of pulling the paper tray 9C into the feed device 50. Accordingly, no pulling force being a resultant force of the first spring 771 and the second spring 772 is applied to the engagement projection 71 engaging the engagement portion 723 of the second lever 720, thereby releasing the pulling force pulling the paper tray 9C into the feed device 50.

According to this example embodiment, since a plurality of pressing members including the first spring 771 and the second spring 772 presses the first lever 710 in the direction of pulling the paper tray 9C into the feed device 50, a constant pulling force is applied to the paper tray 9C from start to finish of pulling the paper tray 9C.

In addition, the assist mechanism 70 further includes the velocity-dependent rotary damper 750 depicted in FIG. 10 increasing and decreasing a load for decelerating movement of the paper tray 9C according to a speed of pulling the first lever 710. Therefore, when the paper tray 9C has a small sliding resistance and a great speed of moving the paper tray 9C by the pulling force, the velocity-dependent rotary damper 750 increases a load to decelerate the speed of movement of the paper tray 9C, thereby preventing the paper tray 9C from being attached to the feed device 50 with excessive force. Conversely, when the paper tray 9C has a great sliding resistance and a small speed of moving the paper tray 9C by the pulling force, the velocity-dependent rotary damper 750 decreases a load, so that the paper tray 9C can be smoothly attached to the feed device 50.

In addition, when a user pushes the paper tray 9C into or pulls the paper tray 9C out of the feed device 50, the load of the velocity-dependent rotary damper 750 does not act on the paper tray 9C. Thus, the user can smoothly push or pull the paper tray 9C into or out of the feed device 50, thereby improving usability of the printer 500.

Moreover, according to this example embodiment, the second lever 720 includes the engagement teeth 721 engaging the rotary gear 751 of the rotary damper 750, serving as a velocity-dependent damper, and separating from the rotary gear 751 of the rotary damper 750. When the paper tray 9C is pulled out from the feed device 50, the engagement projection 71 supplies the paper tray 9C with a force pulling the paper tray 9C out of the feed device 50 to cause the engagement teeth 721 to separate from the rotary gear 751. Therefore, when the paper tray 9C is pulled out from the feed device 50, the load of the rotary damper 750 does not act on the paper tray 9C. Conversely, when the paper tray 9C is pulled into the feed device 50, the engagement projection 71 does not supply the paper tray 9C with a force pulling the paper tray 9C out of the feed device 50 to cause the engagement teeth 721 to engage the rotary gear 751. Therefore, when the paper tray 9C is pulled into the feed device 50, the load of the rotary damper 750 can be applied to the paper tray 9C.

According to this example embodiment, since the assist mechanism 70 includes the first and second spring adjusters 741 and 742 adjusting a force pulling the paper tray 9C, the pulling force can be adjusted according to the type of unit to be moved.

Moreover, when the paper tray 9C is pulled into the feed device 50, when the engagement projection 71 contacts an area of the second lever 720 other than the engagement portion 723 of the second lever 720, since the second lever 720 is supported by the first lever 710 such that the second lever 720 escapes from a line of movement of the engagement projection 71 due to a force in a direction of attachment of the paper tray 9C applied to the second lever 720 by the engagement projection 71, even when the second lever 720 is in a position after the paper tray 9C is attached to the feed device 50.

In addition, according to this example embodiment, a pressing member, that is, the first spring 771 and the second spring 772, is a spring, thereby obtaining a pulling force at low cost.

Since the assist mechanism 70 is used for pulling the paper tray 9C, a user can smoothly attach the paper tray 9C to the feed device 50, so that the paper tray 9C can be properly positioned in the feed device 50.

Since the assist mechanism 70 is used for pulling the openable duplex unit 30 depicted in FIG. 1, the duplex unit 30 can be properly positioned in the printer 500, that is, the duplex unit 30 is in a closed position, thereby improving usability of the duplex unit 30.

The present invention has been described above with reference to specific example embodiments. Nonetheless, the present invention is not limited to the details of example embodiments described above, but various modifications and improvements are possible without departing from the spirit and scope of the present invention. The number, position, shape, and the like, of the above-described constituent elements are not limited to the above-described example embodiments, but may be modified to the number, position, shape, and the like, which are appropriate for carrying out the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. An assist mechanism for aiding movement of a retractable unit, reciprocally moving between an open and a closed position, of a device body, comprising:

a pressing device configured to press the retractable unit toward the open position in which the retractable unit is extended;

a stopper mechanism configured to control and release retraction of the retractable unit to the closed position in which the retractable unit is retracted, the stopper mechanism including a stopper and a blocking member configured to contact the stopper;

an engagement member provided in the retractable unit;

a catch portion configured to engage the engagement member;

an assist member configured to assist retraction of the retractable unit to the closed position by a force configured to pull the retractable unit toward the closed position when the retractable unit is set in the device body and the engagement member engages the catch portion;

a release member configured to release the force pulling the retractable unit when the retractable unit is moved to the closed position;

a first swingable member pressed to the closed position; and a second swingable member supported by the first swingable member, wherein, the catch portion includes a clearance configured to maintain a separation between the engagement member and a catch surface facing a pulling direction when engaged with the engagement member, the assist member is configured to contact the release member, the engagement member is configured to engage the catch portion, and the blocking member is configured to contact the stopper in a state in which the engagement member is spaced from the catch surface, and when the retractable unit is moved to the closed position, the release member contacts the second swingable member to cause the second swingable member to swing in a direction opposite to the closed position relative to the first swingable member.

2. The assist mechanism according to claim 1, further comprising a plurality of pressing members to press the first swingable member to the closed position.

3. The assist mechanism according to claim 2, wherein when the retractable unit moves to the closed position, the engagement member contacts an area of the second swingable member other than the catch portion and the engagement member supplies the second swingable member with a force to the closed position of the retractable unit, so that the second swingable member is movable in a direction in which the second swingable member escapes from a line of movement of the engagement member.

4. The assist mechanism according to claim 2, wherein the plurality of pressing members includes springs.

5. The assist mechanism according to claim 1, further comprising a velocity-dependent damper to increase and decrease a load for decelerating a speed of movement of the retractable unit according to a velocity of retraction of the retractable unit.

6. The assist mechanism according to claim 5, wherein the load of the velocity-dependent damper does not act on the retractable unit when the retractable unit moves to the open position.

7. The assist mechanism according to claim 6, wherein, the velocity-dependent damper includes a rotary gear, and increases and decreases the load according to torque of the rotary gear, the swingable second member includes engagement teeth configured to engage and separate from the rotary gear, and when the retractable unit is moved to the closed position, the second swingable member swings with the engagement teeth engaging the rotary gear, and when the retractable unit is supplied with a force to the open position, the second swingable member swings back with the engagement teeth separating from the rotary gear.

8. The assist mechanism according to claim 1, further comprising a tension adjuster configured to adjust the force pulling the retractable unit.

9. The assist mechanism according to claim 1, wherein the retractable unit is a paper tray.

10. An image forming apparatus including the assist mechanism according to claim 9, the image forming apparatus further comprising a feed device configured to feed a sheet of recording media from a tray for holding the recording media, the tray being retractable into the image forming apparatus.

11. The assist mechanism according to claim 1, wherein the retractable unit is a duplex unit.

12. An image forming apparatus including the assist mechanism according to claim 11, the image forming apparatus further comprising:

an image forming device configured to form an image on a sheet of recording media;

a sheet conveyance path configured to convey the sheet to the image forming device; and a duplex unit openably closable relative to the image forming apparatus, the duplex unit including a re-feeding path configured to convey the sheet bearing the image formed by the image forming device to the image forming device.

13. The assist mechanism according to claim 1, wherein the device body is an image forming apparatus.

* * * * *

UNITED STATES PATENT AND TRADEMARK OFFICE

CERTIFICATE OF CORRECTION

PATENT NO. : 8,428,506 B2
APPLICATION NO. : 12/458444
DATED : April 23, 2013
INVENTOR(S) : Miki It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 591 days.

Signed and Sealed this
Ninth Day of December, 2014

Michelle K. Lee

Michelle K. Lee
*Deputy Director of the United States Patent and Trademark Office*